US005572927A

United States Patent [19]

Sirvet

[11] Patent Number: 5,572,927

[45] Date of Patent: Nov. 12, 1996

[54] VERTICAL TRACK FOR MANDREL ASSEMBLY OF CONTINUOUS MOTION CAN DECORATORS

[75] Inventor: Enn Sirvet, Washington Township, N.J.

[73] Assignee: Sequa Corporation, Hackensack, N.J.

[21] Appl. No.: 521,979

[22] Filed: Aug. 31, 1995

[51] Int. Cl.[6] ..... B41F 17/22

[52] U.S. Cl. ..... 101/40

[58] Field of Search ..... 101/38.1, 39, 40, 101/40.1

[56] References Cited

U.S. PATENT DOCUMENTS

| | | | |
|---|---|---|---|
| 3,766,851 | 10/1973 | Sirvet et al. | 101/40 |
| 4,140,053 | 2/1979 | Skrypek et al. | 101/40 |
| 4,821,638 | 4/1989 | Uithoven | 101/40 |
| 5,111,742 | 5/1992 | DiDonato et al. | 101/40 |

*Primary Examiner*—Ren Yan

*Attorney, Agent, or Firm*—Mitchell D. Bittman; Jerome M. Berliner

[57] ABSTRACT

Apparatus for decorating cylindrical articles includes a plurality of mandrel assemblies mounted on a carrier that rotates continuously on a main axis. The assemblies are equally spaced from each other and are disposed in an array surrounding the main axis. A cam device drives the base for limited radial movements relative to the carrier. Each assembly includes a base and a cantilevered mandrel pivotally mounted to the base on a mandrel pivot that is parallel to the main axis. For each revolution of the carrier a decorator engages an article on the mandrel and applies a decoration to such article. Engagement between the articles and decorator produces a reaction force that tends to tile the free end of the mandrel radially inward about the cam means as a center, if the reaction force is permitted to do so, decorating quality will be degraded. A bracing device is provided to resist tilting of the mandrel. On form of such bracing device includes a track and a roller that is mounted on the base and rides on the track. The tracks are fixedly mounted on the carrier and are disposed generally in a common plane at right angles to the main axis.

20 Claims, 7 Drawing Sheets

3
3
14
17
13
88
40
20
A
45
42
68
66
65
51
41
39
49
48
52
95
96
97
18
84
82
83
81
19

VERTICAL TRACK FOR MANDREL ASSEMBLY OF CONTINUOUS MOTION CAN DECORATORS

BACKGROUND OF THE INVENTION

E. Sirvet et al. U.S. Pat. No. 3,766,851 issued Oct. 23, 1973 for Continuous Can Printer and Handling Apparatus describes relatively high speed apparatus for applying decorations to the exterior of cylindrical containers while they are mounted on mandrels disposed along the periphery of a large rotating wheel-like carrier. In continuous can printer apparatus of this type, means are provided to assure that when a mandrel moves through the decorating zone along a normal path for printing, such mandrel is properly loaded with cylindrical container. If a particular mandrel is empty or is loaded improperly, such mandrel is moved away from the path for printing to a no-print position wherein neither an empty mandrel nor an improperly loaded container will engage the printing blanket. Examples of prior art means for retracting unloaded and misloaded mandrels to a no-print position are disclosed in J. P. Skrypek et al. U.S. Pat. No. 4,140,053 issued Feb. 20, 1979 for Mandrel Mounting and Trip Mechanism For Continuous Motion Decorator and R. DiDonato et al. U.S. Pat. No. 5,111,742 issued May 12, 1992 for Mandrel Trip Subassembly For Continuous Motion Can Decorator.

In the aforesaid U.S. Pat. No. 4,140,053 each mandrel is part of a subassembly that is mounted on a pivot axis to a continuously rotating carrier. When an unloaded or misloaded mandrel is detected a linear actuator acting through a crank and an eccentric moves the pivot axis for the entire subassembly and in so doing moves the unloaded or misloaded mandrel away from its normal or print path so that neither the mandrel nor a misloaded container will engage the printing blanket. While this type of mechanism operates well at high production rates, say 1200 cans per minute, mounting and dismounting of the subassembly from the carrier is time consuming and adjustments must be made while the subassembly is mounted on the carrier.

In accordance with the aforesaid U.S. Pat. No. 5,111,742, the mandrel tripping actuator and mandrel are combined in a subassembly that may be adjusted when the subassembly is dismounted from the carrier. In particular, this subassembly includes a base with a rotary actuator thereon, which actuator is powered directly by a non-mechanical source of energy, preferably pressurized air. The actuator includes a rotor having an extension on which the mandrel is rotatably mounted. The mandrel axis is slightly offset laterally from the rotor axis so that limited pivoting motion of the latter causes the mandrel to move between a normal radially outward print position and a radially inward trip or no-print position. Two guide rods extend from the base and are received in radially extending guide channels of the carrier to removably mount the subassembly on the carrier and guide the subassembly radially in accordance with dictates of a stationary cam track cooperating with a cam follower that is part of the subassembly.

SUMMARY OF THE INVENTION

In accordance with the instant invention high speed performance for mandrel trip subassemblies of the type disclosed in the aforesaid U.S. Pat. No. 5,111,742 is improved by providing means that inhibits tilting of the subassembly relative to the carrier because of force that develops from engagement between a mandrel mounted can and the printing blanket. If that type of tilting is permitted to go unchecked, there is excessive frictional engagement between the guide rods and the slide bearing sleeves in the guide channels. This accelerates wear of the bearing sleeves so that a sloppy fit develops between them and the guide rods which move therein, to the point where there is a negative impact on the quality of can printing that is obtained.

As will hereinafter be seen in detail, pursuant to the instant invention subassembly tilting is inhibited through sliding engagement of a follower (roller) on the subassembly with a brace or track on the rotating carrier. Further, cooperation between the follower and the brace also acts to limit deflection of the cantilevered mandrel relative to the carrier.

Accordingly, a primary object of the instant invention is to provide an improved construction for high speed continuous motion decorators for cylindrical containers.

Another object is to provide apparatus of this type that achieves superior printing for extended periods of very high speed operation.

A further object is to provide apparatus of this type constructed so as to increase intervals between maintenance procedures.

A still further object is to provide apparatus of this type in which bracing is provided to inhibit tilting of mandrel assemblies relative to the rotating carrier on which the assemblies are mounted.

These objects as well as other objects of this present invention shall become readily apparent after reading the following description of the accompanying drawings in which:

BRIEF DESCRIPTION OF THE DRAWINGS

FIG. 3 is a front elevation of the apparatus portion of FIG. 2 with the can receiving mandrels removed, looking in the direction of arrows 3—3 of FIG. 2.

DETAILED DESCRIPTION OF THE DRAWINGS

Figure 1:
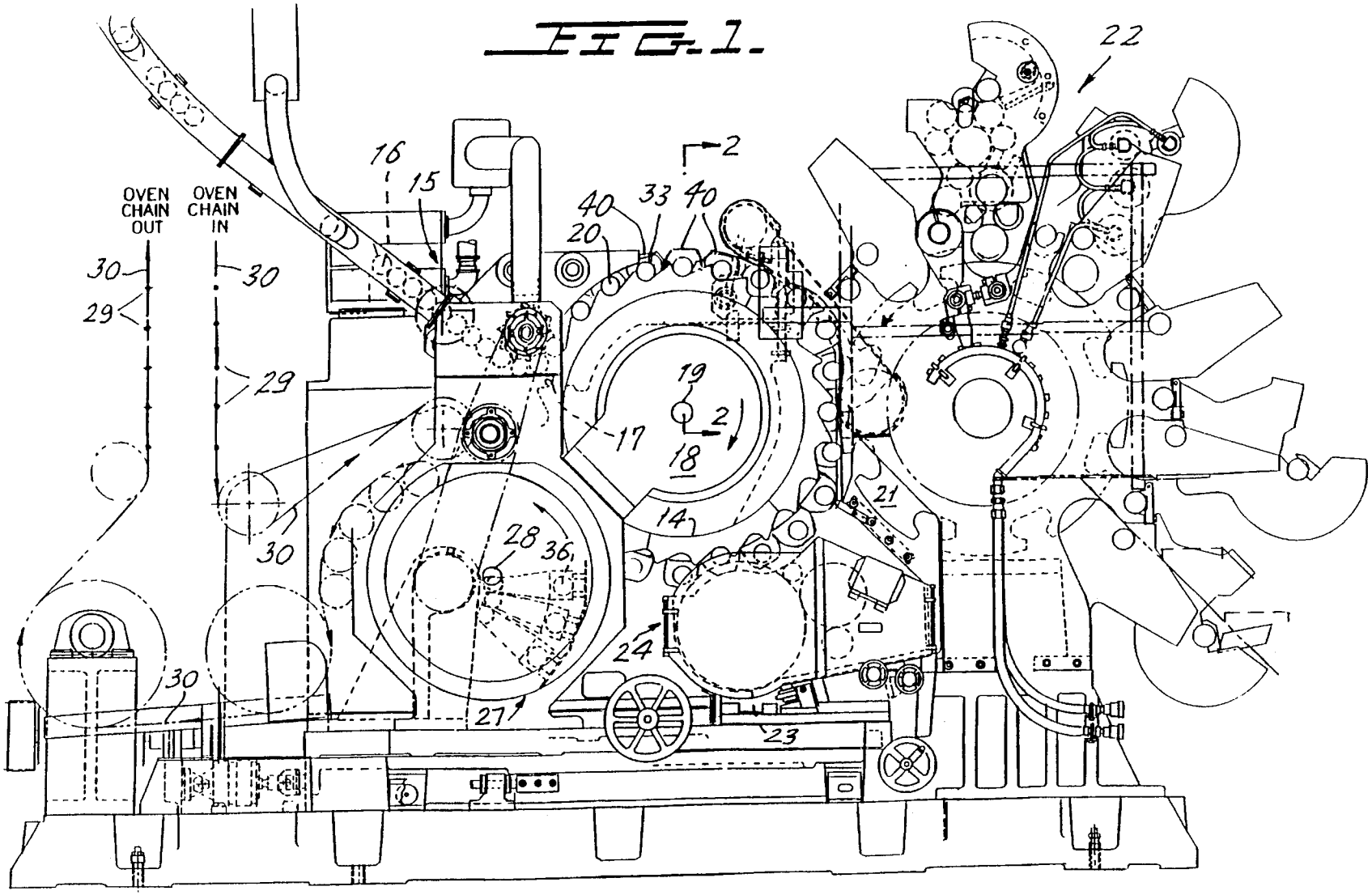
FIG. 1 is a front elevation of continuous motion decorating apparatus that includes bracing devices constructed in accordance with teachings of the instant invention to block tilting of the mandrel/actuator subassemblies during decorating.

As may be desired to amplify the following description, disclosures of the aforesaid U.S. Pat. Nos. 3,766,851, 4,140,053 and 5,111,742 are incorporated herein by reference. Now referring to the Figures and more particularly to FIG. 1 which illustrates continuous motion decorating apparatus of the general type described in the aforesaid U.S. Pat. No.

Figure 2:
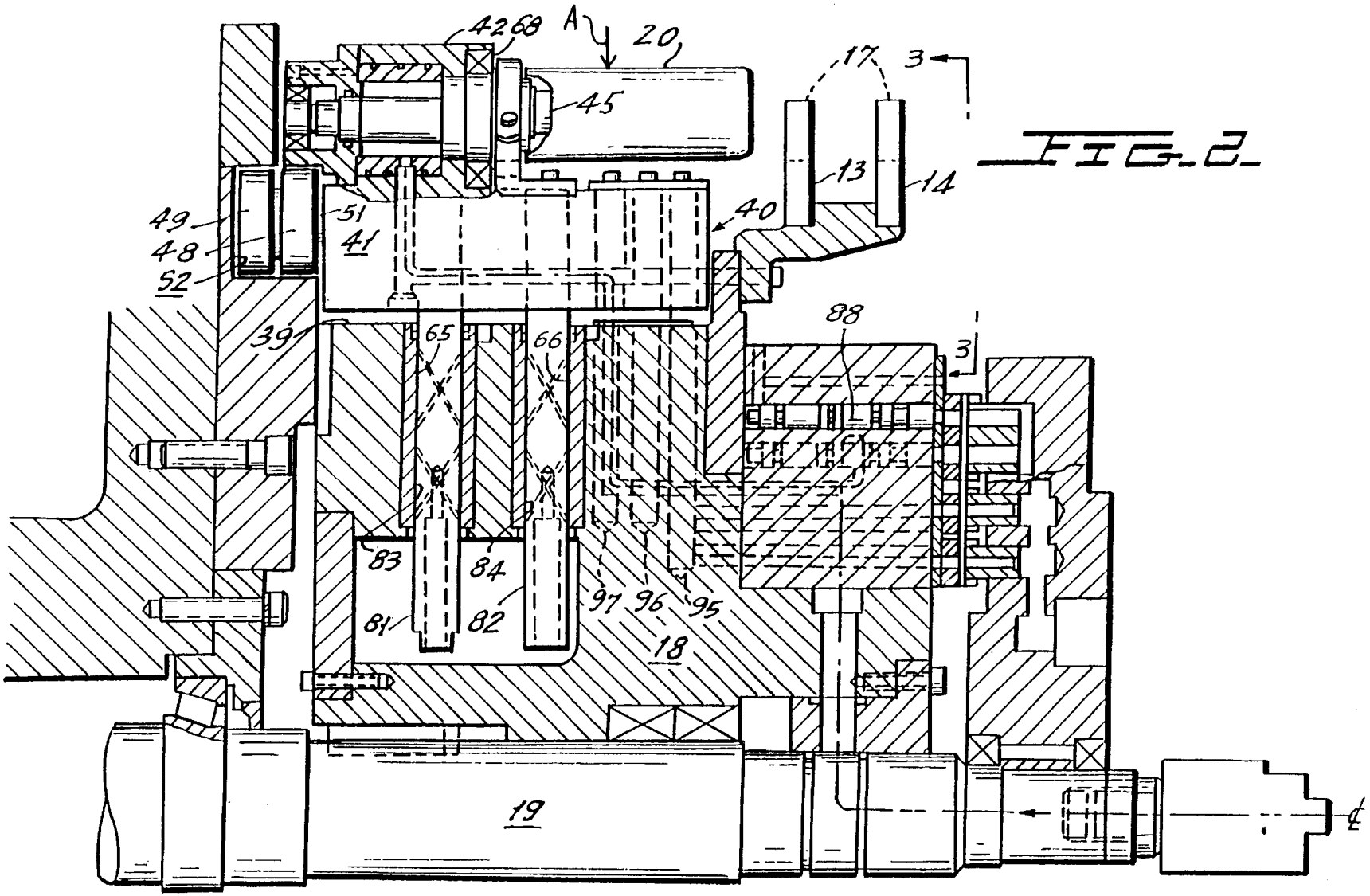
FIG. 2 is an enlarged fragmentary cross-section of the mandrel carrier and loading wheel taken through line 2—2 of FIG. 1 looking in the direction of arrows 2—2.
Figure 7:
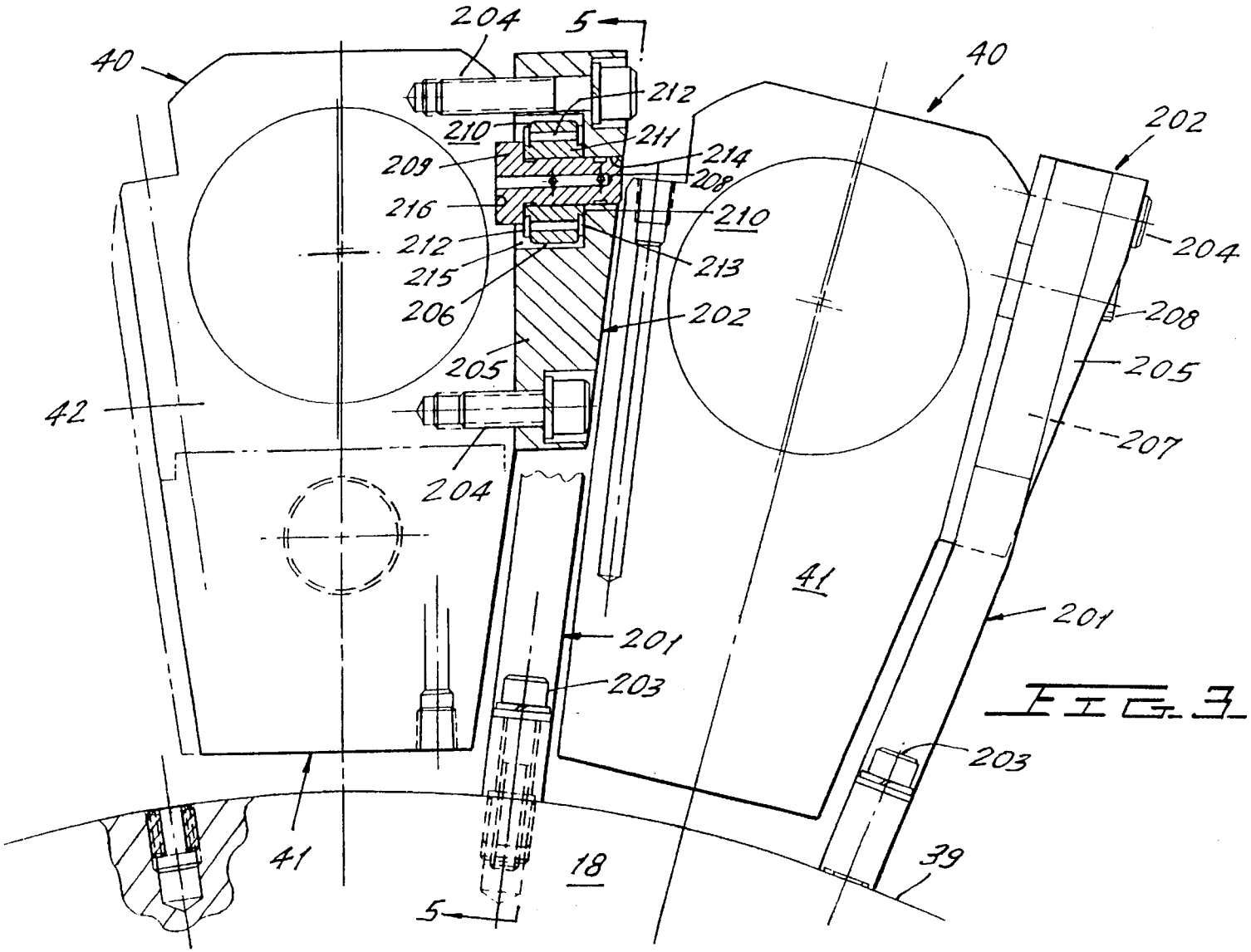
FIG. 7 is an exploded somewhat schematic perspective showing the relationship between major elements of a mandrel/actuator subassembly and the elements for bracing same against tilting.
Figure 4:
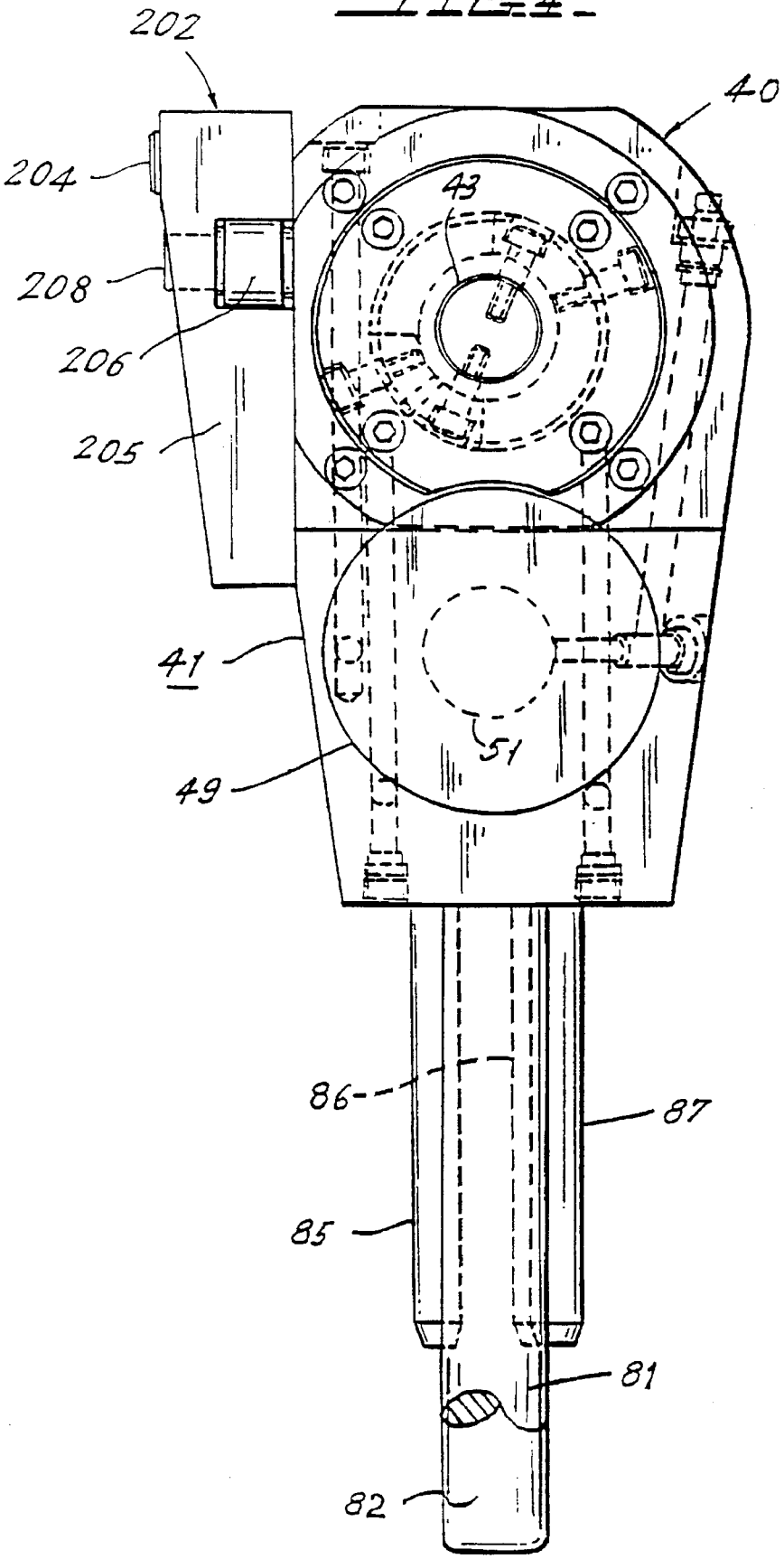
FIG. 4 is a rear elevation of one of the mandrel/actuator subassemblies, with bracing elements removed.

3,766,851 for decorating aluminum beverage cans and other cylindrical containers. Briefly, the apparatus of FIG. 1 includes infeed conveyor chute 15 which receives undecorated cans 16, each open at one end thereof, from a supply (not shown) and places them in arcuate cradles or pockets 17 along the periphery of spaced rings 13, 14 (FIG. 2). The latter are fixedly secured to wheel-like carrier 18 keyed to horizontal drive shaft 19. Freely rotatable horizontal spindles or mandrels 20 are also mounted to carrier 18, with each mandrel 20 being in spaced horizontal alignment with an individual pocket 17 in a short region extending downstream from infeed conveyor 15. In this short region undecorated cans 16 are moved horizontally to the rear, being transferred from each cradle 17 to a mandrel 20. Suction applied through an axial passage 101 (FIG. 7) extending to the outboard or front end of mandrel 20, draws container 16 rearward to its final seating position on mandrel 20.

While mounted on mandrels 20, cans 16 are decorated by being brought into engagement with continuously rotating image transfer mat or blanket 21 of the multicolor printing press decorating section indicated generally by reference numeral 22. Thereafter, and while still mounted to mandrels 20, each decorated can 16 is coated with a protective film of varnish applied thereto by engagement with the periphery of applicator roll 23 in the overvarnish unit indicated generally by reference numeral 24. While transfer wheel 27 rotates about shaft 28 as a center, cans 16 with decorations and protective coatings thereon are transferred from mandrels 20 to suction cups 36 mounted near the periphery of transfer wheel 27. Cans 16 carried by transfer wheel 27 are deposited on generally horizontal but nevertheless inclined pins 29 projecting from chain-type output conveyor 30 which carries cans 16 through a curing oven (not shown).

Each mandrel 20 should be loaded properly with a can 16 by the time mandrel 20 is in the proximity of sensor 33, which detects whether each mandrel 20 is properly loaded with a can 16. If sensor 33 detects that a mandrel 20 is unloaded or is not properly loaded, then as this particular mandrel 20 passes through the decorating zone wherein printing blanket 21 normally engages can 16 on mandrel 20, this unloaded or misloaded mandrel 20 is moved to a "no-print" position. In the no-print position, as this mandrel 20 moves through the decorating zone it will be spaced from the periphery of blanket 21.

Each mandrel 20 is part of a mandrel/actuator subassembly 40. A plurality of such subassemblies 40 are mounted to carrier 18 along periphery 39 thereof, there is equal angular spacing between each of the subassemblies 40 and they are guided for in and out radial movement relative to periphery 39 of carrier 18. Each subassembly 40 also includes a machined base 41 having, at its rear, an integrally formed hollow bulbous portion 42 that is hollow extends radially outward and constitutes the outer housing for a pneumatically powered rotary operator or actuator which includes a rotor 43 having diametrically opposed vanes 44 secured thereto. The pivot axis for rotor 43 is parallel to and laterally offset slightly from the rotational axis 45 for mandrel 20. A pair of freely rotatable rollers 48, 49, constituting a cam follower, are mounted on cantilevered stub shaft 51 that projects from the rear of base 41. As carrier 18 rotates cam follower rollers 48, 49 cooperate with cam track 52 to establish radial positions for base 41 relative to carrier periphery 39.

Two axially spaced parallel guide rods 81, 82 extend radially inward from base 41 into guide channels 83, 84, respectively, that extend radially inward from periphery 39 of carrier 18. Channels 83, 84 contain linear bearings in the form of respective sleeves 65, 66. Guide rods 81, 82 are disposed so that the longitudinal axes thereof intersect the rotational main axis 19 for carrier 18. Disposed forward of guide rods 81, 82 and projecting radially inward from base 41 are three hollow rods 85, 86, 87 that ride in bores 95, 96, 97 of carrier 18 to act as the equivalent of flexible control lines for vacuum and pressure that is fed to mandrel 20 and/or the rotary actuator within housing 42.

Each of the subassemblies 40 is associated with an individual control valve 88 (FIG. 2) which is on carrier 18 and is connected to hollow rods 85, 86, 87 through conduits or airways that include connected borings in carrier 18. For an operational description of subassembly 40 reference is made to the aforesaid U.S. Pat. No. 5,111,742.

Figure 5:
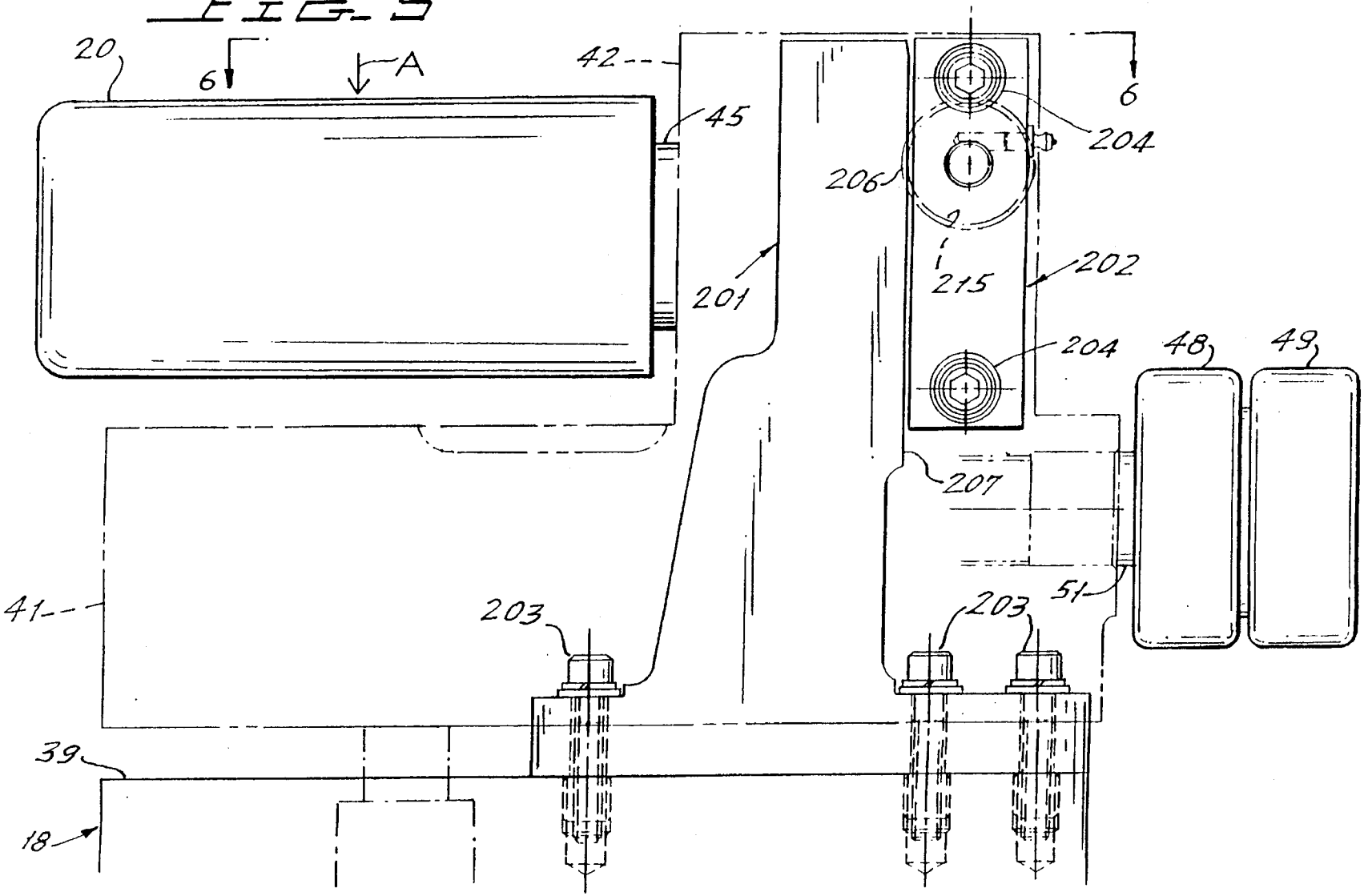
FIG. 5 is a side elevation looking in the direction of arrows 5—5 of FIG. 3 illustrating the relationship between the bracing elements.
Figure 6:
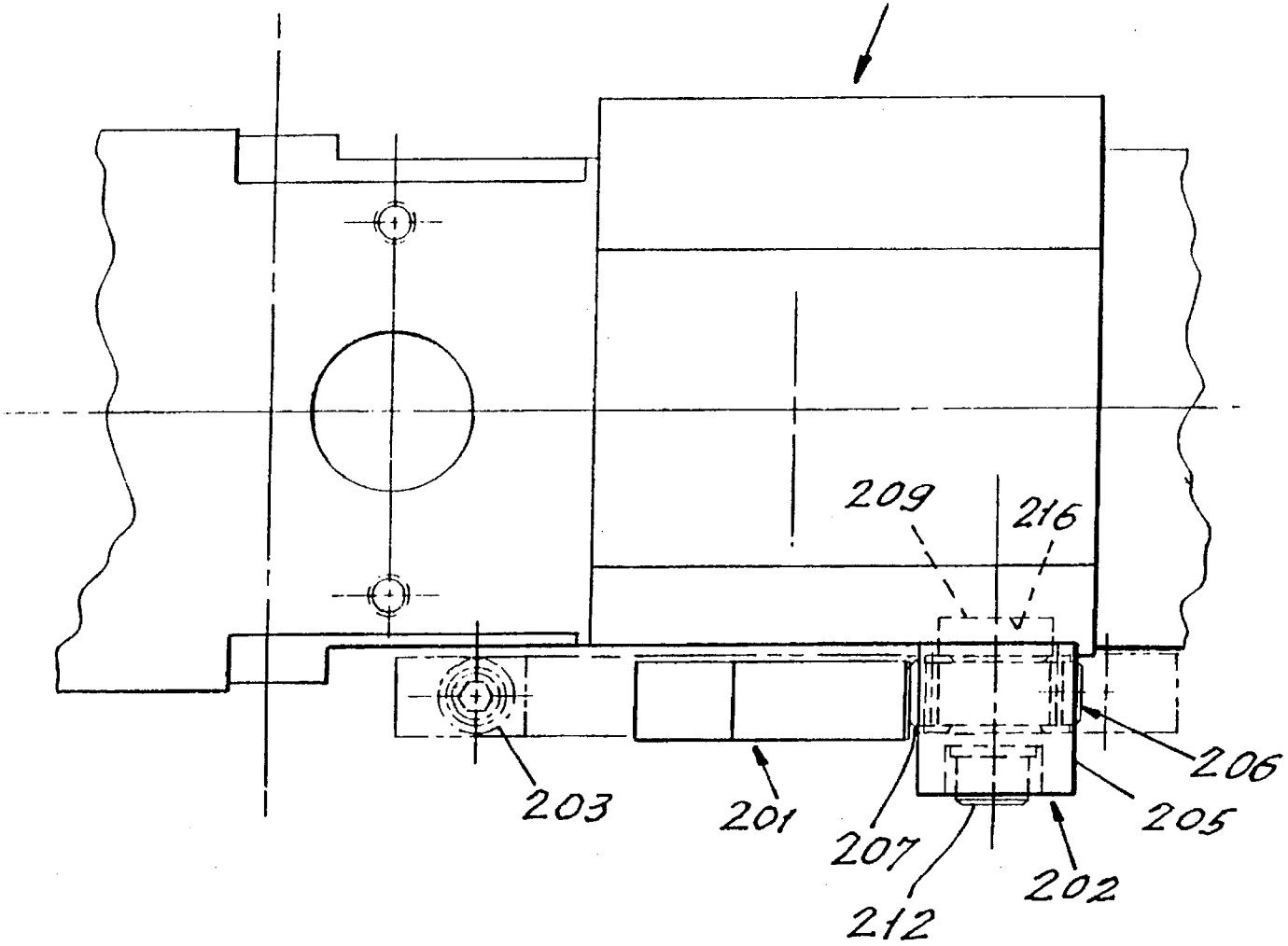
FIG. 6 is an elevation looking in the direction of arrows 6—6 of FIG. 5, with the can receiving mandrels removed.
Figure 7:
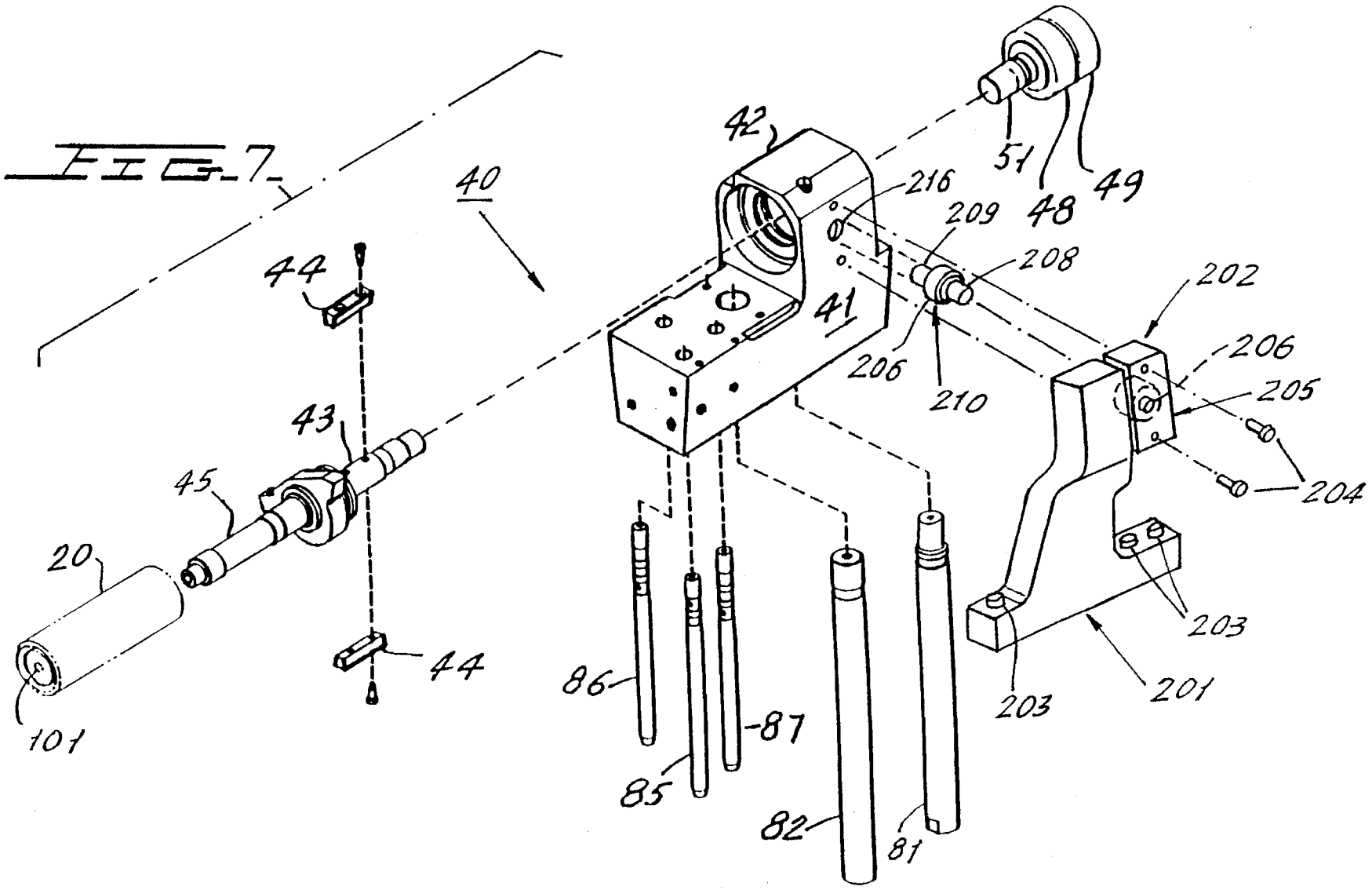

During printing, engagement of a can 16 with printing blanket 21 causes a substantial radially inward reaction force to be exerted against mandrel 20, as indicated by arrow A in FIG. 5. This exerts a force on subassembly 40 which tends to tilt same forward and radially inward about the point of engagement between cam follower 48 and 360° control cam track 52. Tilting of this type puts undue strain upon bearing sleeves 65, 66 (FIG. 2) thereby reducing the useful life thereof.

In order to restrict forward radially inward tilting of subassembly 40 because of forces generated during decorating, the instant invention provides a bracing device that includes brace and follower sections 201, 202 that are in operative slidable (as by rolling) engagement and movable relative to one another. That is, brace section 201 extends radially outward from and is fixedly secured to periphery 39 of rotating mandrel carrier 18 by three bolts 203. Follower section 202 is secured to subassembly base 41 at one side of base portion 42 by two bolts 204 that extend through clearance holes in support member 205 of section 202. The latter also includes follower roller 206 which is mounted on pin 208 having enlarged head 209. Roller 206 rides on track 207 provided by brace section 201 along the rear edge thereof.

Roller 206 is the outer ring of bearing unit 210 that also includes inner ring 211 and a plurality of rod-like bearing elements 212 disposed between rings 206 and 211 being operatively positioned by retainer rings 213. Pin shaft 208 extends through inner ring 211 and the headless end of shaft 208 is disposed within clearance aperture 214 of support members 205, extending into recess 215 wherein most of roller 206 is disposed. Pin head 209 extends into locating recess 216 in one side of base portion 41. With bracing device 201, 202 in place, the moment generated by decorating reaction force A and acting to tilt subassembly 40 is resisted by the engagement between roller 206 of follower section 202 and rear facing track 207 of brace section 201. All of the tracks 207 are disposed generally in a common vertical plane which is at right angles to horizontal main rotational axis 19 for mandrel carrier 18.

It should now be apparent to those skilled in the art that many of the anti-tilting benefits obtained by the cooperation of follower roller 206 carried by subassembly 40 with an individual radial brace track 207 secured to carrier 18, may be obtained with other arrangements. For example, a radial brace track on each subassembly 40 may be engaged by an individual follower roller secured to carrier 18; or a follower roller at the front of each subassembly base 41 that may ride on a common stationary cam track or brace that is parallel to subassembly positioning cam 52*a*, at least while subassembly 40 is in the printing zone; or a common roller on a stationary axis may engage a cam track segment on each subassembly base 41 while subassembly 40 is in the printing zone, such common stationary roller being at the front of base 41 and radially inward of the cam track segment.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Apparatus for decorating cylindrical articles, said apparatus including:

a carrier mounted for continuous rotation on a main axis;

a plurality of mandrel subassemblies mounted on said carrier in an array about said main axis as a center and equal angular center-to-center spacings between adjacent ones of mandrel subassemblies;

decorating means past which said subassemblies move as said carrier rotates;

a stationary cam track disposed about said main axis;

each of said subassemblies including a base, a cylindrical article receiving cantilevered mandrel having a free end and another end opposite said free end, said mandrel being loaded and unloaded at said free end, said mandrel being rotationally supported on said base at said another end, with a rotational axis for said mandrel being parallel to and laterally offset from said main axis, a cam follower on said base cooperating with said stationary cam track to radially position said subassembly so that normally an article on said mandrel is in operative engagement with said decorating means during a predetermined range of angular movement for said subassembly about said main axis;

said operative engagement between said article on said mandrel and said decorating means during said predetermined range of angular movement for said subassembly about said main axis generating a reaction force that is directed against said mandrel in a direction tending to tilt said mandrel by driving its said free end radially inward relative to said main axis about a fulcrum established by engagement between said cam follower and said cam track; and a bracing device to resist tilting of said mandrel by said reaction force, said device including a first section that is fixed axially and radially relative to said main axis and a second section that is connected to said base and is movable therewith;

while an article on said mandrel is in engagement with said decorating means, said first and second sections being in sliding engagement with each other at a location outward radially of said carrier and said second section exerting an opposing force against said first section, with said opposing force increasing and decreasing in relation to increases and decreases in said reaction force.

2. Apparatus for decorating cylindrical articles as set forth in claim 1 in which said free end of said mandrel is forward of said another end, and said cam follower is rearward of said base.

3. Apparatus for decorating cylindrical articles as set forth in claim 2 in which for each of said subassemblies engagement between said first and second sections of said bracing device is behind said mandrel and in front of said cam follower.

4. Apparatus for decorating cylindrical articles as set forth in claim 1 in which for each of said subassemblies said first section defines an individual rearward facing track that is engaged by an individual one of said second sections.

5. Apparatus for decorating cylindrical articles as set forth in claim 4 in which said second section includes a follower roller that rides on said track.

6. Apparatus for decorating cylindrical articles as set forth in claim 5 in which said first sections extend radially outward from said carrier at its periphery.

7. Apparatus for decorating cylindrical articles as set forth in claim 6 in which each of said follower rollers rotates on an axis that is transverse to said main axis and each of said cam followers rotates on an axis that is parallel to said main axis.

8. Apparatus for decorating cylindrical articles as set forth in claim 4 in which said tracks are generally in a common plane that is at right angles to said main axis.

9. Apparatus for decorating cylindrical articles as set forth in claim 8 in which said common plane is vertical and said main axis is horizontal.

10. Apparatus for decorating cylindrical articles as set forth in claim 9 in which said free end of said mandrel is forward of said another end, and said cam follower is rearward of said base.

11. Apparatus for decorating cylindrical articles as set forth in claim 1 wherein each of said subassemblies includes a guide rod that extends into a guide channel in said carrier whereby cooperation of the cam followers with the stationary cam track directs said subassemblies to move linearly relative to said carrier.

12. Apparatus for decorating cylindrical articles as set forth in claim 4 wherein for each of the subassemblies the guide rod extends radially inward from the base at a location in front of said cam follower.

13. Apparatus for decorating cylindrical articles as set forth in claim 12 wherein the carrier has a periphery from which the guide channel extends radially inward.

14. Apparatus for decorating cylindrical articles as set forth in claim 13 wherein said guide channels are disposed so that their longitudinal axes intersect the main axis.

15. Apparatus for decorating cylindrical articles as set forth in claim 14 in which said free end of said mandrel is forward of said another end, and said cam follower is rearward of said base.

16. Apparatus for decorating cylindrical articles as set forth in claim 15 in which for each of said subassemblies engagement between said first and second sections of said bracing device is behind said mandrel and in front of said cam follower.

17. Apparatus for decorating cylindrical articles as set forth in claim 14 in which for each of said subassemblies, said first section of said bracing device defines an individual rearward facing track that is engaged by an individual one of said second sections.

18. Apparatus for decorating cylindrical articles as set forth in claim 17 in which said second section includes a follower roller that rides on said track.

19. Apparatus for decorating cylindrical articles as set forth in claim 18 in which said first sections extend radially outward from said carrier at its periphery.

20. Apparatus for decorating cylindrical articles as set forth in claim 19 in which each of said follower rollers rotates on an axis that is transverse to said main axis and each of said cam followers rotates on an axis that is parallel to said main axis.

* * * * *